US005169410A

United States Patent [19]

Wright

[11] Patent Number: 5,169,410

[45] Date of Patent: Dec. 8, 1992

[54] METHODS FOR STABILIZING GASOLINE MIXTURES

[75] Inventor: Bruce E. Wright, The Woodlands, Tex.

[73] Assignee: Betz Laboratories, Inc., Trevose, Pa.

[21] Appl. No.: 764,549

[22] Filed: Sep. 24, 1991

[51] Int. Cl.[5] ..... C10L 1/22

[52] U.S. Cl. ..... 44/415

[58] Field of Search ..... 44/415

[56] References Cited

U.S. PATENT DOCUMENTS

| | | | |
|---|---|---|---|
| 1,992,014 | 2/1935 | Rogers | 44/9 |
| 2,305,676 | 12/1942 | Chenicek | 44/72 |
| 2,318,196 | 5/1943 | Chenicek . | |
| 2,333,294 | 11/1943 | Chenicek | 44/72 |
| 2,608,476 | 8/1952 | Strickland | 44/430 |
| 3,053,682 | 9/1962 | Chenicek et al. | 44/430 |
| 3,556,748 | 1/1971 | Stedman | 44/72 |
| 3,994,698 | 11/1976 | Worrel | 44/415 |
| 4,016,198 | 4/1977 | Wilder | 260/486 |
| 4,051,067 | 9/1977 | Wilder | 252/401 |
| 4,166,726 | 9/1979 | Harle | 44/73 |
| 4,647,289 | 3/1987 | Reid | 44/57 |
| 4,647,290 | 3/1987 | Reid | 44/57 |
| 4,648,885 | 3/1987 | Reid | 44/57 |
| 4,744,881 | 5/1988 | Reid | 208/48 |
| 4,749,468 | 6/1988 | Roling et al. | 208/48 |
| 4,797,504 | 1/1989 | Roling | 560/4 |

*Primary Examiner*—Jacqueline Howard

*Attorney, Agent, or Firm*—Alexander D. Ricci; Bruce E. Peacock

[57] ABSTRACT

Oxidative stability of gasoline mixtures is improved by adding to the gasoline a phenylenediamine compound (I) in combination with a strongly basic organoamine compound (II). The compound (II) may comprise alkyphenol-polyamine-formaldehyde Mannich reaction products, hydroxylamines, polyethylenepolyamines, and members of the group of piperazine, aminoalkyl substituted pipearazine and amino substituted alicyclic alkanes.

13 Claims, No Drawings

METHODS FOR STABILIZING GASOLINE MIXTURES

FIELD OF THE INVENTION

The present invention pertains to methods for increasing the oxidative stability of gasoline mixtures and especially those gasoline mixtures contaminated by the presence of acidic impurities therein.

BACKGROUND OF THE INVENTION

Gasoline is defined as a complex mixture of hydrocarbons that is used as fuel for internal combustion engines. Gasoline manufactured today is derived from petroleum and is used in automobile, aircraft, marine engines and small engines designed for miscellaneous end-uses. The composition and characteristics of gasoline vary with the source, manufacturing method and end-use requirement of the product.

Gasoline was initially produced by the simple distillation of crude oil. The types of hydrocarbons found in such "straight-run" gasolines include paraffins, aromatics and naphthenes (e.g., cycloparaffins). The number of carbon atoms in the hydrocarbon fraction, molecules falling within the gasoline boiling range, is usually from about $C_4$ to $C_{12}$.

Today, gasoline is produced in petroleum refineries by a plurality of processes. For example, fractional distillation is still used as one refinery method for gasoline production. However, the gasoline mixtures so produced are usually low in octane content and are therefore normally supplemented with gasolines produced by other methods to increase the octane content.

Other production methods include pyrolytic cracking wherein higher molecular weight hydrocarbons, such as those in gas oils, are either catalytically cracked or thermally cracked. Reforming is used to upgrade low-octane gasoline fractions into higher octane components by use of a catalyst. Alkylation of $C_3$ and $C_4$ olefins with isobutane is also practiced to provide a high octane content gasoline source.

Polymer gas or polygas is an olefinic gasoline blending component resulting from a polymerization process. Several polymerization processes exist (Nelson, Petroleum Refining Engineering, 4th Edition, pp. 700–701, 722–735), including thermal polymerization of cracked still gases ($C_3$–$C_5$) or acid catalyzed, either phosphoric or sulfuric acid, polymerization of similar feedstocks. Additionally, another commercially important "Polygas" process involves passing the feedstock over a diatomaceous earth impregnated with phosphorus pentoxide.

A process referred to as dimerization is used to combine hydrocarbon fractions, such as butenes and propylene, to form higher molecular weight branched hydrocarbons, such as isoheptenes. Gasoline produced by this process is referred to as "dimate" gasoline. The process frequently uses phosphoric acid as a catalyst.

Stripper gasoline is obtained by a process that uses steam injected into a fractionator column with the steam providing the heat needed for separation. The gasoline can come from either a hydrodesulfurizer (HDS) unit or a fluidized catalytic cracking (FCC) unit. Normally, stripper gasoline from a FCC unit is highly unstable and only small percentages thereof can be blended with a more stable gasoline product in order to obtain the final motor fuel product.

Additionally, isomerization is used to convert low octane paraffins into branched chain isomers with higher octane.

Despite the particular method of production, gasolines generally suffer from oxidative degradation. That is, upon storage, gasoline can form gummy, sticky resin deposits that adversely affect combustion performance. Further, such oxidative degradation may result in undesirable color deterioration.

The need for stabilizing treatment is even more acute in those gasolines in which acidic contaminants are present. For example, the presence of naphthenic acids in gasolines contributes to instability. Naphthenic acid is a general term that is used to identify a mixture of organic acids present in petroleum stock or obtained due to the decomposition of the naphthenic or other organic acids. As is used in the art, the acid neutralization number (mg KOH/gm) (as per ASTM D 664) is a quantitative indication of the acids present in the hydrocarbon. Oftentimes, known gasoline stabilizers, such as the phenylenediamines lose effectiveness in such acidic gasoline mediums. There is a need to provide such stabilization treatment in those gasolines having an acid neutralization number of 0.1 or greater and such treatment is especially desirable when the acid neutralization number is even higher (i.e., 0.15 or greater).

PRIOR ART

Many attempts to stabilize gasolines have been made throughout the years. Phenylenediamines, as taught in U.S. Pat. No. 3,556,748 (Stedman) have been used for years for this purpose. Alkylenediamines such as diethylenetriamine, triethylenetetramine, tetraethylenepentamine, etc., in combination with gum inhibitors, such as N-substituted alkylaminophenols, etc., are used to enhance gasoline stability in U.S. Pat. No. 2,305,676 (Chenicek). Similarly, alkylamines, such as diethylamine, tributylamine, ethylamine, or alkylenediamines, such as propylenediamine, and basic cyclic nitrogen compounds, such as piperdine and the like, are taught as being effective in preventing color degradation of gasolines in U.S. Pat. No. 1,992,014 (Rogers). The '014 Rogers patent indicates that specified amines may be used in combination with gum inhibiting aromatic reducing agents, such as p-phenylenediamine, to stabilize color deterioration due to exposure of the gasoline to sunlight.

In U.S. Pat. No. 2,318,196 (Chenicek), aminopyridines are used in combination with N-butyl-p-aminophenol to enhance stability of cracked gasolines with U.S. Pat. No. 2,333,294 (Chenicek) teaching the use of substituted alkylenediamines, including N,N-diethylethylenediamine, etc., in combination with known gum inhibitors, such as alkylphenols, N-substituted alkylaminophenols, substituted phenol ethers, and hardwood tar distillates, etc., in the same environment.

U.S. Pat. No. 4,647,290 (Reid) teaches the combination of N-(2-aminoethyl)piperazine and N,N-diethylhydroxylamine to enhance color stability of distillate fuel oils, such as straight-run diesel fuel with U.S. Pat. No. 4,647,289 (Reid) directed toward combined use of triethylenetetramine and N,N-diethylhydroxylamine for such purpose. The combination of N-(2-aminoethyl)piperazine, triethylenetetraamine and N,N-diethylhydroxylamine is disclosed in U.S. Pat. No. 4,648,885 (Reid) to improve stability of distillate fuel oils.

Fouling in oxygen containing hydrocarbons having a bromine number of about 10 or above is inhibited by the combination of unhindered or partially hindered phenols and oil soluble strong amine bases as taught in U.S. Pat. No. 4,744,881 (Reid). Here, specifically enumerated amine bases include monoethanolamine, N-(2-aminoethyl)piperazine, cyclohexylamine, 1,3-cyclohexanebis(methylamine), 2,5-dimethylaniline, 2,6-dimethylaniline, diethylenetriamine, triethylenetetramine, etc.

Other patents that may be of interest include U.S. Pat. Nos. 4,720,566 (Martin) and 4,797,504 (Roling), teaching, respectively, conjoint use of hydroxylamines and para-phenylenediamines to inhibit acrylonitrile polymerization and acrylate ester polymerization. In Wilder patents 4,051,067 and 4,016,198, polyalkylene amines and arylenediamines are used, in combination, to inhibit carboxylic acid ester polymerization.

U.S. Pat. No. 4,749,468 (Roling) teaching deactivation of first row transition metal species in hydrocarbon fluids by use of Mannich reaction products formed via reaction of alkylphenol, polyamines, and aldehyde sources.

Despite the efforts of the prior art, there remains a need for stabilizing treatment that is effective with a variety of gasoline types and at relatively low levels of concentration. Additionally, such treatment is even more desirable in those gasolines having acidic impurities therein which, heretofore, have proven especially prone to instability and gum formation.

DESCRIPTION OF THE INVENTION

In accordance with the invention, gasoline mixtures, such as those formed via "straight-run", pyrolysis, reforming, alkylation, stripper, isomerization and polymerization techniques are stabilized by adding to such gasoline mixtures, a (I) phenylenediamine compound and (II) a strongly basic organo-amine compounds having a pKb less than about 7.

As to the phenylenediamine compounds (I) that are suitable, these include phenylenediamine and derivatives having at least one N—H group. It is thought that ortho-phenylenediamine or derivatives thereof having at least one N—H group are suitable for use in accordance with the instant invention. However, the preferred phenylenediamine is para-phenylenediamine having the formula

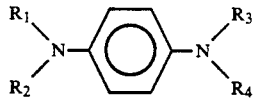

wherein $R^1$, $R^2$, $R^3$ and $R^4$ are the same or different and are hydrogen, alkyl, aryl, alkaryl, or aralkyl groups with the proviso that at least one of $R^1$, $R^2$, $R^3$ or $R^4$ is hydrogen. More preferably, the alkyl, aryl, alkaryl and aralkyl groups have one to about twenty carbon atoms. The alkyl, alkaryl and aralkyl groups may be straight or branched-chain groups. Exemplary para-phenylenediamines include p-phenylenediamine wherein $R^1$, $R^2$, $R^3$ and $R^4$ are hydrogen; N,N,N'-trialkyl-p-phenylenediamines, such as N,N,N'-trimethyl-p-phenylenediamine, N,N,N'-triethylphenylene-p-diamine, etc.; N,N'-dialkyl-p-phenylenediamines, such as N,N'-dimethyl-p-phenylenediamine, N,N'-diethyl-p-phenylenediamine, N,N'-di-sec-butyl-p-phenylenediamine, etc.; N-phenyl-N',N'-dialkyl-p-phenylenediamines, such as N-phenyl-N',N'-dimethyl-p-phenylenediamine, N-phenyl-N',N'-diethyl-p-phenylenediamine, N-phenyl-N',N',-dipropyl-p-phenylenediamine, N-phenyl-N',N'-di-n-butyl-p-phenylenediamine, N-phenyl-N',N'-di-sec-butyl-p-phenylenediamine, N-phenyl-N'-methyl-N'-ethyl-p-phenylenediamine, N-phenyl-N'-methyl-N'-propyl-p-phenylenediamine, etc.; N-phenyl-N'-alkyl-p-phenylenediamines, such as N-phenyl-N'-methyl-p-phenylenediamine, N-phenyl-N'-ethyl-p-phenylenediamine, N-phenyl-N'-isopropyl-p-phenylenediamine, N-phenyl-N'-butyl-p-phenylenediamine, N-phenyl-N'-isobutyl-p-phenylenediamine, N-phenyl-N'-sec-butyl-p-phenylenediamine, N-phenyl-N'-tert-butyl-phenylenediamine, N-phenyl-N'-n-pentyl-p-phenylenediamine, N-phenyl-N'-n-hexyl-p-phenylenediamine, N-phenyl-N'-(1-methylhexyl)-p-phenylenediamine, N-phenyl-N'-(1,3-dimethylbutyl)-p-phenylenediamine, N-phenyl-N'-(1,4-dimethylpentyl)-p-phenylenediamine, etc. Preferably, the paraphenylenediamine is selected from the group consisting of N-phenyl-N'-(1,3-dimethylbutyl)-p-phenylenediamine, N,N'-di-sec-butyl-p-phenylenediamine, N-phenyl-N'-(1,4-dimethylpentyl)-p-phenylenediamine and p-phenylenediamine wherein $R^1$, $R^2$, $R^3$ and $R^4$ are all hydrogen.

Most preferably, I is N-phenyl-N'-(1,4 dimethylpentyl)-p-phenylenediamine, Naugard I3-available from Uniroyal.

In one aspect of the invention, stabilization improvement is shown in those gasolines that are treated with such phenylenediamines (PDA) (I) wherein considerable acidic components exist in the gasoline. That is, in gasolines having acid numbers of about 0.10 (mg KOH/g) and greater, improvement over the traditional use of (I) alone as the gasoline stabilizer is shown by using, the amine (II) in combination with the PDA. Although applicant is not to be bound to any particular theory of operation, it is thought that the PDA performance is adversely affected by such high acid concentrations. Perhaps the addition of the strongly basic organo-amine neutralizes the acids, thus allowing the PDA to better fulfill its known and intended function in improving stability of the gasoline mixture as evidenced by inhibition of color and gum formation.

As to the strongly basic organo amines (II) that may be used, these are characterized by having a pKb of less than about 7. These amines are characterized as being members of the classes II(a), Mannich reaction products of an alkylphenol-polyamine and aldehyde source; II(b) hydroxylamines; II(c) polyethylenepolyamines; II(d) member selected from piperazine, aminoalkyl substituted piperazine and amino-substituted alicyclic alkanes.

More specifically, the strong base organo-amine may comprise a II(a) Mannich reaction product of an alkylphenol-polyamine-aldehyde reaction as set forth in U.S. Pat. No. 4,749,468 (Roling et al), the disclosure of which and of U.S. Pat. No. 4,166,726 are both incorporated herein by reference. These Mannich reaction products are formed via reaction of the reactants (1), (2) and (3); wherein (1) is an alkyl substituted phenol of the structure

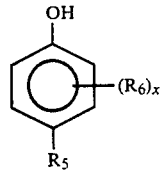

II(a)(1)

wherein $R^5$ and $R^6$ are the same or different and are independently selected from alkyl, aryl, alkaryl, or arylalkyl of from about 1 to 20 carbon atoms, x is 0 or 1; wherein (2) is a polyamine of the structure

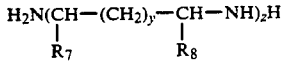

II(a)(2)

wherein Z is a positive integer, $R^7$ and $R^8$ may be the same or different and are independently selected from H, alkyl, aryl, aralkyl, or alkaryl having from 1 to 20 carbon atoms, y may be 0 or 1; and wherein (3) is an aldehyde of the structure

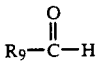

II(a)(3)

wherein $R_9$ is selected from hydrogen and alkyl having from 1 to 6 carbon atoms.

As to exemplary compounds falling within the scope of Formula II(a)(1) supra, p-cresol, 4-ethylphenol, 4-t-butyl-phenol, 4-t-amylphenol, 4-t-octylphenol, 4-dodecyl-phenol, 2,4-di-t-butylphenol, 2,4-di-t-amylphenol, and 4-nonylphenol may be mentioned. At present, it is preferred to use 4-nonylphenol as the Formula II(a)(1) component.

Exemplary polyamines which can be used in accordance with Formula II(a)(2) include ethylenediamine, propylenediamine, diethylenetriamine, triethylenetetramine, tetaethylenepentamine and the like, with ethylenediamine being preferred.

The aldehyde component II(a)(3) can comprise, for example, formaldehyde, acetaldehyde, propanaldehyde, butryladehyde, hexaldehyde, heptaldehyde, etc., with the most preferred being formaldehyde which may be used in its monomeric form or, more conveniently, in its polymeric form (i.e., paraformaldehyde).

As is conventional in the art, the condensation reaction to prepare the Mannich products II(a) may proceed at temperatures from about 50° to 200° C. with a preferred temperature range being about 75°-175° C. As is stated in U.S. Pat. No. 4,166,726, the time required for completion of the reaction usually varies from about 1-8 hours, varying of course with the specific reactants chosen and the reaction temperature.

As to the molar range of components (1):(2):(3) which may be used to prepare the Mannich reaction product, this may fall within 0.5-5:1:0.5-5. Especially preferred is the product of nonylphenol:ethylenediamine:paraformaldehyde reaction in a 2:1:2 molar ratio amount as specified in Example I of U.S. Pat. No. 4,749,468.

The hydroxylamines II(b) that may be conjointly used with the p-phenylenediamines (I) to inhibit gum and color formation in gasoline mixtures may be represented by the formula

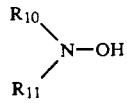

II(b)

wherein $R_{10}$ and $R_{11}$ are the same or different and are hydrogen, alkyl, or alkaryl groups. The alkyl and alkaryl groups may be straight or branched-chain groups. Preferably, the alkyl, or alkaryl groups have one to about twenty carbon atoms. Examples of suitable hydroxylamines include N,N-diethylhydroxylamine; N,N-dipropylhydroxylamine; N,N-dibutylhydroxylamine; N,N-butylethylhydroxylamine; N,N-2-ethylbutryloctylhydroxylamine; N,N-didecylhydroxylamine; N,N-dibenzylhydroxylamine; N-benzylhydroxylamine; N,N-butylbenzylhydroxylamine; N,N-methylbenzylhydroxylamine; N,N-ethylbenzylhydroxylamine; etc. More than one such hydroxylamine, such as mixtures of N-benzylhydroxylamines and N,N-methylbenzylhydroxylamines, may be utilized if desired. Most preferably, the hydroxylamine is N,N-diethylhydroxylamine.

As to the polyethylenepolyamines II(c) that can be used conjointly with the phenylenediamines as the strongly basic organo-amine, these are represented by the formula $$NH_2(CH_2CH_2NH)_dH \qquad \text{II(c)}$$

wherein d is from 2 to about 10. Exemplary compounds include diethylenetriamine, triethylenetetramine, tetraethylenepentamine, and pentaethylenehexamine. Of this II(c) grouping, diethylenetriamine and triethylenetetraamine are preferred.

Additionally, the strongly basic organo-amine may be chosen from the group of (IId), piperazine and aminoalkyl piperazines such as 2-(aminoethyl)piperazine, and the aminosubstituted alicyclic alkanes, such as cyclohexylamine and dimethylcyclohexylamine.

The para-phenylenediamine (I) and strongly basic organo-amine compound (II) are added to the gasoline for which stabilization, i.e., inhibition of oxidative degradation, is desired in an amount of 1-10,000 parts of the combination (I and II) based upon 1 million parts of the gasoline mixture. Preferably, about 1-1500 ppm of the combination is added with a range of from 1-100 ppm being even more preferred.

The relative ratio (molar) of components (I and II) to be added may be on the order of (I):(II) of from 1:1 to 10:1 with a more preferred ratio being from 5:1 to 10:1.

The compounds may be added to the gasoline mixture under ambient conditions as a room or storage temperature stabilizer to stabilize the resulting gasoline mixture in tanks, drums, or other storage or shipment containers.

The combined treatment (I and II) is preferably dissolved in an aromatic organic solvent, such as heavy aromatic naphtha (H.A.N.), or xylene. Based upon presently available experimental data the combined treatment preferred for use is (I) PDA-N-phenyl-N'-(1,4-dimethylpentyl)-p-phenylenediamine; Naugard I3—available Uniroyal Chem. Co;

(II) MD-Mannich Reaction Product—nonylphenol-ethylenediamine-paraformaldehyde (2:1:2-molar ratio). See Example I of U.S. Pat. No. 4,749,468, available Betz Process Chemicals, Inc., Woodlands, Tex.

(I):(II) molar 5:1—dissolved in H.A.N.

In order to illustrate the invention more clearly, the data set forth below were developed. The following examples are included as being illustrative of the invention and should not be construed as limiting the scope thereof.

EXAMPLES

In order to demonstrate the efficacy of the combined treatment of the invention in stabilizing gasoline, the ASTM D525-80 test procedure was utilized. In accordance with this method, a gasoline sample is placed in a pressure vessel along with the candidate stabilizer or, for purposes of control, no candidate gasoline stabilizer is added. The pressure vessel is closed and oxygen is introduced into the vessel through a Schrader-type valve fitting until an over-pressure of about 100 psig is attained. The vessel is then heated in a water bath to about 100° C. until a drop in pressure is noted signifying a loss of antioxidant activity. The period of time elapsing until a pressure drop is indicated is known as the "induction time", with longer induction times signifying increased stabilizer efficacy of the candidate treatment. Using this procedure, the following results were obtained using a variety of different gasoline types.

TABLE I

| Dimate Gasoline - Western Refinery | | | |
|---|---|---|---|
| Candidate | Concentration (ppm active) | Induction Time (± standard deviation) | Comments |
| Control (N = 4) | — | 206 ± 37 | — |
| PDAI (N = 3) | 20 | 401 ± 9 | — |
| PDAII (N = 2) | 20 | 360 ± 15 | — |
| MD | 20 | 234 | — |
| MD | 0.5 | 222 | — |
| PDAI/MD (N = 2) | 18.4/1.6 | 471 ± 13 | synergism exhibited |
| PDAII/MD | 18.4/1.6 | 370 | additive |

TABLE II

| Dimate Gasoline - Western Refinery | | | |
|---|---|---|---|
| Candidate | Concentration (ppm active) | Induction Time (± standard deviation) | Comments |
| Control (N = 7) | — | 144 ± 12 | — |
| PDAI (N = 3) | 5 | 252 ± 23 | — |
| TETA | 2 | 177 | some efficacy alone |
| PDAI/TETA (N = 3) | 5/2 | 270 ± 17 | — |
| PDAI/DETA | 5/2 | 274 | — |
| PDAI/MD (N = 2) | 5/2 | 236 ± 3 | — |
| PDAI/CHXA | 5/2 | 172 | efficacy reduced by amine |
| PDAI/AEP | 5/2 | 326 | possible synergism |
| PDAI/ascorbic acid | 5/1 | 205 | efficacy reduced by acid |
| PDAI/ascorbic acid | 5/2 | 193 ± 18 | efficacy reduced by acid |
| PDAI/citric acid | 5/1 | 242 | no effect by acid |
| PDAI/citric acid | 5/2 | 240 | no effect by acid |
| PDAII | 20 | 436 | — |
| PDAII (N = 2) | 5 | 186 ± 16 | — |
| PDAII/TETA | 20/5 | 492 | possible synergism |
| PDAII/TETA | 5/2 | 263 ± 7 | synergistic |

TABLE III

| Stripper Gasoline from Texas FCC Unit | | | |
|---|---|---|---|
| Candidate | Concentration (ppm active) | Induction Time (± standard deviation) | Comments |
| Control (N = 6) | — | 319 ± 13 | |
| PDAI (N = 4) | 5.6 | 424 ± 13 | |
| PDAI | 2.8 | 373 | |

TABLE III-continued

| Stripper Gasoline from Texas FCC Unit | | | |
|---|---|---|---|
| Candidate | Concentration (ppm active) | Induction Time (± standard deviation) | Comments |
| MD | 0.4 | 337 | |
| MD | 3.8 | 336 | |
| PDAI/MD | 5.3/0.2 | 443 | — |
| PDAI/DMD | 5.3/0.3 | 434 | — |
| PDAI/DMCHXA | 5.3/0.3 | 437 | — |
| PDAI/AEP | 5.3/0.3 | 437 | possible synergism |
| AEP | 0.5 | 313 | — |
| PDAII | 2.8 | 352 | — |
| PDAII (N = 2) | 5.6 | 398 ± 10 | — |
| PDAII/MD | 5.3/0.2 | 406 | possible synergism |

TABLE IV

| Stripper Gasoline from Midwestern FCC Unit | | | |
|---|---|---|---|
| Candidate | Concentration (ppm active) | Induction Time (± standard derivation) | Comments |
| Control | — | 277 ± 18 | — |
| PDAI | 5 | 380 | — |
| PDAI | 8 | 389 | — |
| PDAI (N = 3) | 10 | 439 ± 17 | — |
| MD | 2 | 263 | no effect |
| MD | 10 | 264 | no effect |
| AEP | 2 | 267 | no effect |
| AEP | 10 | 295 | no effect |
| DMCHXA | 2 | 280 | no effect |
| DMCHXA | 10 | 296 | no effect |
| PDAI/MD | 8/2 | 389 ± 6 | — |

TABLE IV-continued

| Stripper Gasoline from Midwestern FCC Unit | | | |
|---|---|---|---|
| Candidate | Concentration (ppm active) | Induction Time (± standard derivation) | Comments |
| PDAI/DMCHXA | 8/2 | 392 | — |
| PDAI/AEP | 8/2 | 381 | — |

TABLE V-continued

| Mixed Gasoline* from Texas Refinery | | |
|---|---|---|
| Candidate | Concentration (ppm active) | Induction Time (± standard derivation) |
| PDAII/MD | 8/2 | 107 |

*Neutralization Number = 0.07 (mg KOH/g) which is equivalent to 110 ppm butyric acid or around 40 ppm $H_3PO_4$

TABLE VI A

| Polygas* from Eastern Refinery | | | |
|---|---|---|---|
| Candidate | Concentration (ppm active) | Induction Time (± standard derivation) | Comments |
| Control (N = 17) | — | 61 ± 6 | — |
| PDAI | 25 | 1146 | — |
| PDAI (N = 5) | 5 | 377 ± 57 | — |
| PDAI | 2.5 | >240 | — |
| PDAI (N = 3) | 2.0 | 223 ± 22 | — |
| PDAI/MD | 5/2 | 416 | — |
| PDAI/MD | 5/5 | 459 | possible synergism |
| PDAI/TETA | 5/2 | 429 | — |
| PDAI/CHXA | 5/2 | 384 | — |
| PDAI/DMCHXA (N = 2) | 5/2 | 386 ± 11 | — |
| PDAI/DEHA (N = 2) | 5/2 | 404 ± 1 | — |
| PDAI/DEHA | 5/5 | 445 | — |
| PDAI/DEHA | 2/5 | 359 | possible synergism |
| TETA | 2 | 59 | same as control |
| TETA | 5 | 61 | same as control |
| DMCHXA | 2 | 69 | same as control |
| DMCHXA | 5 | 75 | slight efficacy |
| DEHA | 5 | 80 | slight efficacy |
| PDAII | 25 | 1077 | — |
| PDAII (N = 4) | 5 | 187 ± 54 | — |
| PDAII | 2.5 | 178 | — |
| PDAII (N = 4) | 2 | 118 ± 9 | — |
| DETA (N = 2) | 2 | 67 ± 1 | same as blank |
| DETA | 5 | 67 | — |
| PDAII/MD | 5/2 | 244 ± 1 | additive effect |
| PDAII/TETA (N = 2) | 5/2 | 206 ± 8 | — |
| PDAII/DETA | 5/2 | 203 | — |
| PDAII/DMCHXA (N = 2) | 5/2 | 273 ± 29 | — |
| PDAII/DEHA (N = 2) | 5/2 | 314 ± 15 | synergism |

*Neutralization number = 0.23 (mg KOH/g) which is equivalent to 360 ppm as butyric acid or about 135 ppm of $H_3PO_4$

TABLE V

| Mixed Gasoline* from Texas Refinery | | |
|---|---|---|
| Candidate | Concentration (ppm active) | Induction Time (± standard derivation) |
| Control | — | 54 ± 3 |
| PDAI (N = 3) | 5 | 114 ± 7 |
| PDAI | 8 | 137 |
| PDAI | 10 | 149 |
| MD | 2 | 60 |
| DMCHXA | 2 | 57 |
| TETA | 2 | 64 |
| DEHA | 2 | 60 |
| PDAI/MD (N = 2) | 8/2 | 145 ± 1 |
| PDAI/MD | 5/2 | 123 |
| PDAI/DMCHXA | 5/2 | 116 |
| PDAI/TETA | 5/2 | 133 |
| PDAI/DEHA | 5/2 | 136 |
| PDAII | 5 | 84 |
| PDAII | 8 | 105 |
| PDAII | 10 | 108 |

TABLE VI B

| Pyrolysis Gas from Texas Refinery | | | |
|---|---|---|---|
| Candidate | Concentration (ppm active) | Induction Time (± standard derivation) | Comments |
| Control | — | 368 ± 16 | — |
| PDAI (N = 2) | 2 | 555 ± 13 | — |
| PDAI/MD | 2/1 | 579 | possible synergism |

TABLE VII

| Cat Cracked Gas from Rocky Mountain Refinery | | |
|---|---|---|
| Candidate | Concentration (ppm active) | Induction Time (± standard derivation) |
| Control | — | 260 |
| PDAI | 2 | 382 |
| MD | 1 | 300 |
| TETA | 2 | 318 |
| PDAI/MD | 2/1 | 377 |
| PDAI/TETA | 2/2 | 430 |

TABLE VIII

| Candidate | Dimate Gasoline* from Texas Refinery Concentration (ppm active) | Induction Time (Min.) | Comments |
|---|---|---|---|
| Control (N = 9) | — | 36 ± 8 | — |
| PDAI | 20 | 316 | — |
| PDAI | 18 | 285 | — |
| PDAI | 10 | 225 ± 19 | — |
| PDAI | 5 | 43 | slight efficacy |
| MD | 20 | 53 | slight efficacy |
| MD (N = 2) | 2 | 31 ± 8 | — |
| PDAI/MD | 18/2 | 285 | — |
| PDAI/MD (N = 2) | 10/10 | 217 ± 28 | — |
| PDAI/MD | 5/2 | 47 | — |
| PDAI/DMCHXA | 5/2 | 47 | — |
| PDAI/DEHA | 5/2 | 43 | — |
| PDAI/TETA | 5/2 | 51 | possible synergism |
| DMCHXA | 2 | 26 | same as blank |
| TETA | 2 | 24 | same as blank |
| PDAII | 20 | 235 | — |
| PDAII | 5 | 33 | no efficacy |
| PDAII/MD | 18/2 | 201 | — |
| butyric acid | 100 | 37 | same as blank |
| butyric acid | 10,000 | 27 | same as blank |
| PDAI/butyric acid | 10/100 | 228 | no change in PDAI efficacy |
| PDAI/butyric acid | 10/10,000 | 128 | PDAI efficacy reduced |
| PDAI/MD/butyric acid | 10/10/100 | 233 | — |
| PDAI/MD/butyric acid | 10/10/10,000 | 135 | partial restoration of PDAI efficacy by MD |

*Neutralization number = 0.16 (mg KOH/g) which is equivalent to 250 ppm as butyric acid or about 95 ppm $H_3PO_4$

TABLE IX

| Candidate | FCC Light Cat Gas from Western Refinery Concentration (ppm active) | Induction Time (Min.) | Comments |
|---|---|---|---|
| Control (N = 7) | — | 27 ± 4 | — |
| PDAI (N = 4) | 5 | 63 ± 26 | one point of 4 is high - if thrown out, it is 50 ± 6 |
| PDAI/TETA (N = 2) | 5/2 | 78 ± 40 | — |
| PDAI/DETA (N = 2) | 5/2 | 80 ± 36 | — |
| PDAI/DETA (N = 2) | 5/2 | 77 ± 45 | — |
| PDAI/MD (N = 2) | 5/2 | 79 ± 44 | — |
| PDAI/AEP | 5/2 | 38 | — |
| butyric acid | 1,000 | 23 | same as control |
| PDAI/butyric acid (N = 2) | 5/1,000 | 39 ± 3 | slight reduction of PDAI efficacy |
| PDAI/ascorbic acid | 5/5 | 46 | same as PDAI at 5 ppm |
| PDAI/ascorbic acid | 5/2 | 47 | same as PDAI at 5 ppm |
| PDAI/MD/butyric acid | 5/2/1000 | 58 | PDAI efficacy restored |
| PDAI/TETA/butyric acid (N = 2) | 5/2/1000 | 50 ± 12 | same as PDAI |
| PDAI/TETA/butyric acid (N = 2) | 5/5/1000 | 47 ± 2 | same as PDAI |
| PDAI/DETA/butyric acid | 5/2/1000 | 59 | PDAI efficacy restored |
| PDAI/DEHA/butyric acid (N = 2) | 5/2/1000 | 44 ± 4 | PDAI efficacy partially restored |
| DMDS (N = 2) | 1000 | 28 ± 6 | same as blank |
| PDAI/DMDS | 5/1000 | 74 | no effect on PDAI efficacy |
| PDAI/MD/DMDS | 5/2/1000 | 69 | — |
| PDAI/TETA/DMDS | 5/2/1000 | 73 | — |

TABLE IX-continued

| FCC Light Cat Gas from Western Refinery | | | |
|---|---|---|---|
| Candidate | Concentration (ppm active) | Induction Time (Min.) | Comments |
| PDAI/DEHA/DMDS | 5/2/1000 | 62 | — |

Legend for Tables
N = number of trial runs
PDAI = N-Phenyl N'-(1,4-dimethylpentyl)-p-phenylenediamine, Naugard I3 - available from Uniroyal Chemical Co.
PDAII = N,N'-di-sec-butyl-p-phenylenediamine, available Universal Oil Products as UOP-5
MD = Mannich reaction product formed from nonylphenol/ethylenediamine/paraformaldehyde in 2:1:2 molar ratio. See U.S. Pat. No. 4,749,468 (Rolin et al)
TETA = triethylenetetraamine
DETA = diethylenetriamine
CHXA = cyclohexylamine
DMD = N,N'-bis-(salicylidene)-1,2-cyclohexanediamine, available Dupont
DMCHXA = dimethylcyclohexylamine
AEP= N(2-aminoethyl)piperazine
DMDS = dimethyldisulfide

DISCUSSION

The examples indicate that the combination of (I) phenylenediamine and (II) strongly basic organo amine is effective as an efficacious gasoline stabilizer in accordance with the applicable ASTM standard. In fact, several of the combinations exhibit surprising results. In this regard, the PDAI/MD, PDAI/AEP, PDAII/-TETA, PDAII/DEHA, PDAI/DEHA and PDAI/-TETA treatments may be mentioned.

In Tables I–IV and in Tables VI B and VII, the acid concentration in the gasoline was unknown; therefore, the effects of the herein disclosed mixtures were unforeseen. These Tables were included for completeness. The gasoline described in Table V had low acid content and the benefit of the combined treatments was not observed. The combined treatment is especially effective in the Table VI A and Table VIII gasoline mixtures—which are high in acid number (i.e., ≧0.10 mg KOH/g). Butyric acid was added to the gasoline in Table IX resulting in decreased induction times compared to phenylenediamines without acid. Amines restored most of the induction times when added to the gasoline with the phenylenediamine and acid.

While this invention has been described with respect to particular embodiments thereof, it is apparent that numerous other forms and modifications of the invention will be obvious to those skilled in the art. The appended claims and this invention generally should be construed to cover all such obvious forms and modifications thereof which are within the true spirit and scope of the present invention.

What is claimed is:

1. A method of stabilizing gasoline mixtures comprising adding to said gasoline an effective stabilizing amount of a combination of (I) a phenylenediamine having at least one N-H group and (II) a strongly basic organo-amine having a pKb of less than about 7, said strongly basic organo-amine (II) comprising a Mannich reaction product formed from reaction of reactants (1), (2), and (3) wherein, (1) is an alkyl substituted phenol of the structure

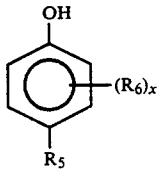

II(a)(1)

wherein $R^5$ and $R^6$ are the same or different and are independently selected from alkyl, aryl, alkaryl, or arylalkyl of from about 1 to 20 carbon atoms, x is 0 or 1; wherein (2) is a polyamine of the structure

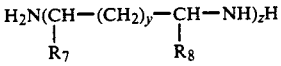

II(a)(2)

wherein Z is a positive integer, $R^7$ and $R^8$ may be the same or different and are independently selected from H, alkyl, aryl, aralkyl, or alkaryl having from 1 to 20 carbon atoms, y may be 0 or 1; and wherein (3) is an aldehyde of the structure

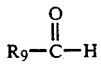

II(a)(3)

wherein $R_9$ is selected from hydrogen and alkyl having from 1 to 6 carbon atoms, said gasoline mixture having an acid neutralization number (mg KOH/gm) of about 0.10 or greater.

2. A method as recited in claim 1 wherein said phenylenediamine (I) comprises the structure

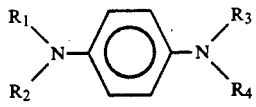

(I)

wherein $R^1$, $R^2$, $R^3$ and $R^4$ are the same or different and are hydrogen, alkyl, aryl, alkaryl, or aralkyl groups with the proviso that at least one of $R^1$, $R^2$, $R^3$ or $R^4$ is hydrogen. More preferably, the alkyl, aryl, alkaryl and aralkyl groups have one to about twenty carbon atoms.

3. A method as recited in claim 2 wherein said phenylenediamine is N-phenyl-N'-(1,4-dimethylpentyl)-p-phenylenediamine.

4. A method as recited in claim 2 wherein said phenylenediamine is N,N'-di-sec-butyl-p-phenylenediamine.

5. A method as recited in claim 1 wherein said Mannich reaction product is a product formed via reaction of nonylphenol-ethylenediamine and paraformaldehyde in a molar ratio of 2:1:2.

6. A method as recited in claim 1 wherein the molar ratio of (I):(II) present in said combination is from 1:1 to 10:1 and from about 1–10,000 parts of said combination is added to said gasoline mixture based upon one million parts of said gasoline mixture.

7. A method as recited in claim 1 wherein the molar ratio of (I):(II) present in said combination is from 5:1 to 10:1 and about 1-1500 parts of said combination is added to said gasoline mixture based upon one million parts of said gasoline mixture.

8. A method as recited in claim 1 wherein said neutralization number is about 0.15 or greater.

9. A method as recited in claim 8 wherein said gasoline mixture comprises dimate gasoline formed by a dimerization procedure.

10. A method as recited in claim 8 wherein said gasoline mixture comprises straight-run distillate gasoline.

11. A method as recited in claim 8 wherein said gasoline mixture comprises pyrolysis gasoline.

12. A method as recited in claim 8 wherein said gasoline mixture comprises stripper gasoline.

13. A method as recited in claim 8 wherein said gasoline mixture comprises polymer gas.

* * * * *